US008178200B2

(12) United States Patent
Wang

(10) Patent No.: US 8,178,200 B2
(45) Date of Patent: May 15, 2012

(54) STRING FOR SPORT RACKETS

(75) Inventor: Tsan-Ching Wang, Changhua (TW)

(73) Assignee: Yao I Fabric Co., Ltd., Changhua (TW)

( * ) Notice: Subject to any disclaimer, the term of this patent is extended or adjusted under 35 U.S.C. 154(b) by 180 days.

(21) Appl. No.: 12/585,858

(22) Filed: Sep. 28, 2009

(65) Prior Publication Data

US 2011/0076498 A1 Mar. 31, 2011

(51) Int. Cl.
*D02G 3/00* (2006.01)
*A63B 51/02* (2006.01)

(52) U.S. Cl. ..... 428/400; 428/397; 428/399; 57/230; 57/234; 57/248; 473/543

(58) Field of Classification Search ..... 428/397, 428/399, 400; 473/524–557; 57/14 R, 144, 57/149, 150, 153, 154, 210, 225, 232, 234, 57/235

See application file for complete search history.

(56) References Cited

U.S. PATENT DOCUMENTS 4,639,397 A * 1/1987 Sato et al. ..... 428/397
4,805,393 A * 2/1989 Reta ..... 57/248
6,117,383 A * 9/2000 Kirschbaum ..... 264/284
7,210,231 B2 * 5/2007 Legrand ..... 30/276

* cited by examiner

*Primary Examiner* — Elizabeth Cole
*Assistant Examiner* — Altrev Sykes
(74) *Attorney, Agent, or Firm* — Rosenberg, Klein & Lee

(57) ABSTRACT

A sport racket string includes a string which is a solid string and multiple recesses are defined in an outer surface of the string. The recesses include different sizes, depths and shapes, and are located in pre-determined ways such as lines so as to increase the friction between the balls and the string. The strings of the present invention are light in weight and allow the users to control the balls efficiently.

18 Claims, 9 Drawing Sheets

STRING FOR SPORT RACKETS

FIELD OF THE INVENTION

The present invention relates to a string, and more particularly, to a string for sport rackets and the string includes multiple recesses defined in outer surface thereof so as to increase the friction with the balls.

BACKGROUND OF THE INVENTION

A conventional sport racket generally includes a post-like shaft with a handle connected to one end and a frame on the other end of the shaft. The frame generally includes a netted area so that the balls bounce back when the users hit the balls by the netted area of the sport racket. These kinds of sport rackets include tennis rackets, badminton rackets and squash rackets.

The netted portion of the rackets includes a sweet spot which is an area on the netted portion and can apply the force of swing to the center of the balls so as to deliver the balls with power and accuracy. There are many skills for the user to send the balls by using the netted portion and the key purpose is to send the balls to the expected position as desired force, speed and distance.

It is noted that the conventional strings for sport rackets generally includes a circular cross section with smooth outer surface which reduces friction between the strings and the balls so that the balls cannot be controlled easily. The conventional strings are made of Nylon, natural gut intestine string, artificial gut intestine string, or artificial fibers.

An improved string known to applicant includes a center core and a first layer wrapped around the outer surface of the center core. The first layer provides improved friction between the strings and the balls. However, the when stringing the strings to the frame, the strings wear out due to mutually contact between the strings. The strings can not be last long.

The present invention intends to provide a string of a sport racket and the string includes recesses defined in an outer surface of the string so as to increase the friction between the strings and the balls.

SUMMARY OF THE INVENTION

The present invention relates to a sport racket string which includes a solid string and multiple recesses are defined in an outer surface of the string.

The primary object of the present invention is to provide a sport racket string which includes recesses defined in its outer surface so as to increase friction between the balls and the strings. The friction enhances the ability for the users to control the distance and direction that the balls are sent.

Another object of the present invention is to provide a sport racket string which includes recesses defined in its outer surface such that the strings are light in weight.

Yet another object of the present invention is to provide a sport racket string which includes recesses defined in its outer surface such that the strings are not likely worn out between the strings.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
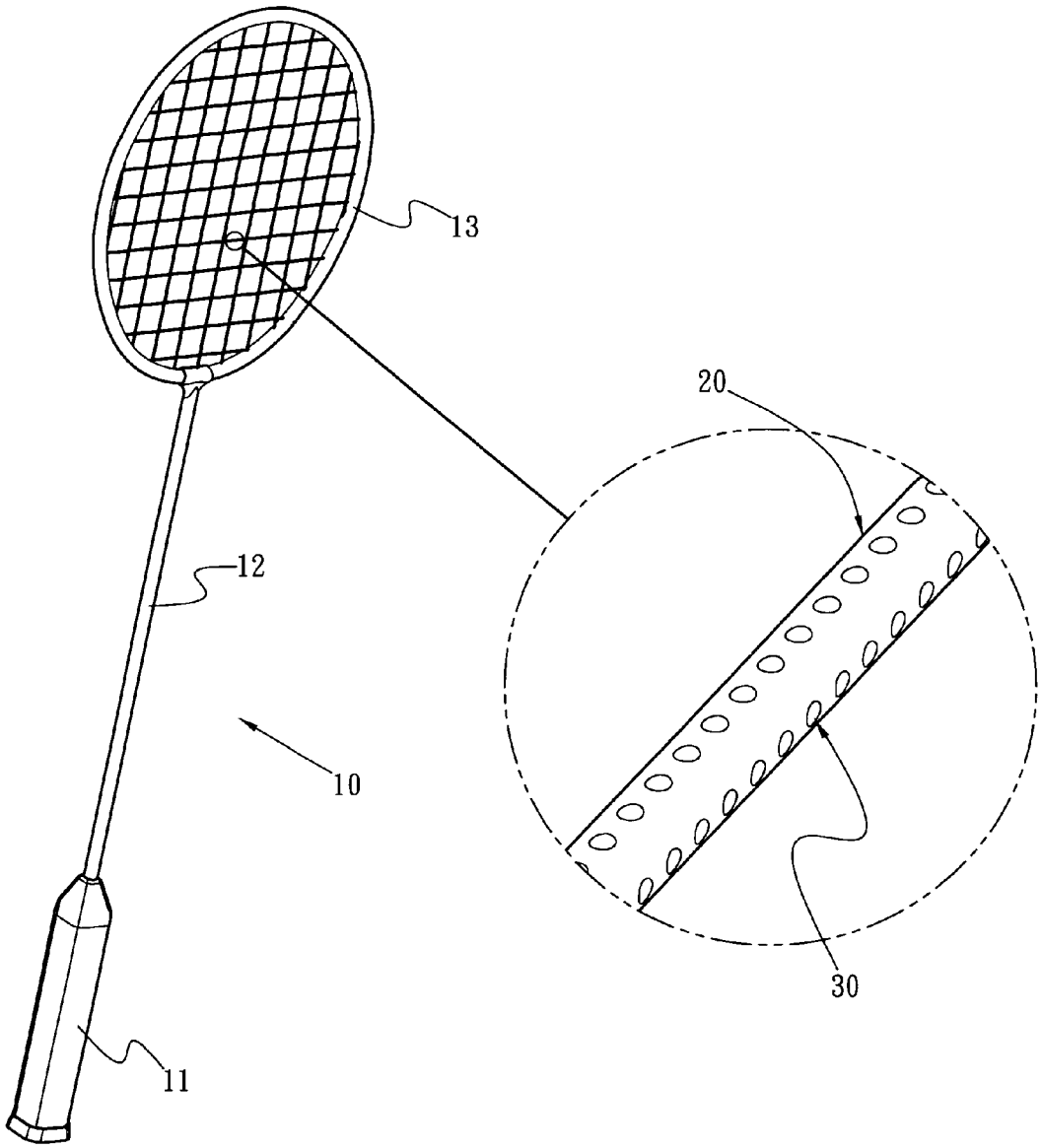
FIG. 1 is a perspective view to show the string of the present invention.
Figure 2:
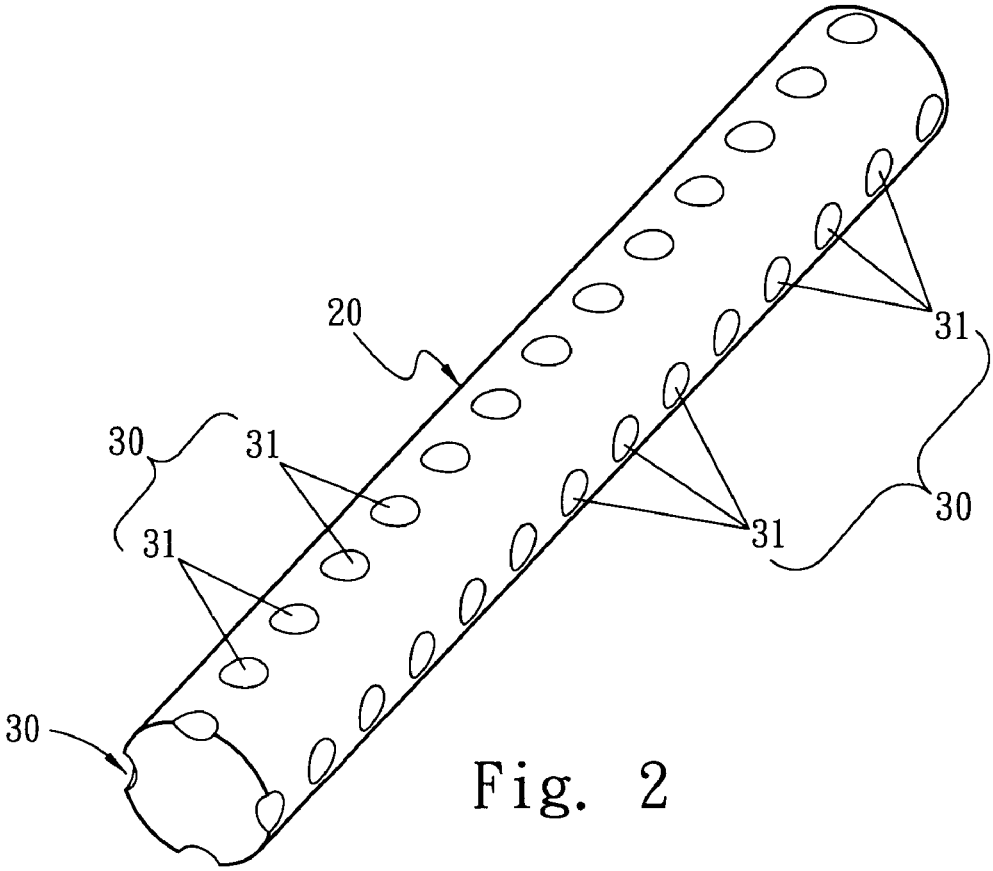
FIG. 2 is a perspective view to show a section of the string of the present invention.
Figure 3:
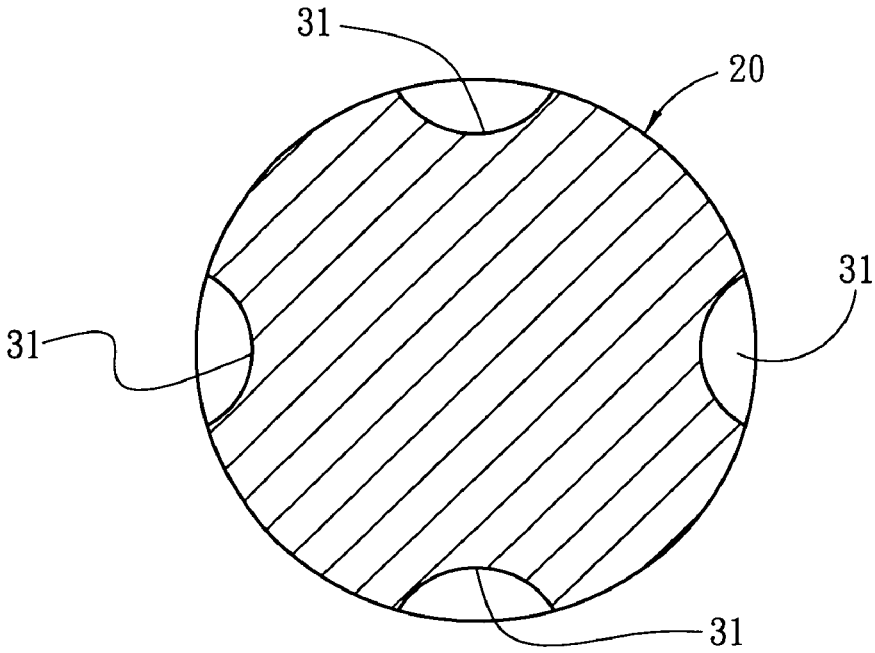
FIG. 3 is a cross sectional view of the string of the present invention.

Referring to FIGS. 1 to 3, a sport racket 10 includes a handle 11, a shaft 12 connected to the handle 11 and a frame 13 is connected to the other end of the shaft 12. The frame 13 includes a netted portion which is composed of altitude and longitude strings 20 of the present invention. The string 20 of the present invention is a solid string and four recess groups 30 are defined in an outer surface of the string 20. The solid string 20 can be made of Nylon, natural gut intestine string, artificial gut intestine string, or artificial fibers.

The recess groups 30 each have multiple recesses 31 which are located in lines and intervals are formed between the recesses 31 along each line. The lines are parallel to the longitudinal axis of the string 20. The recesses 31 have the same diameter and are circular recesses.

The strings 20 with the recesses 31 are light in weight and increase friction between the balls and the strings 20 so that the users can control the balls more accurate.

The recesses 31 not only reduces the weight of the strings 20 and the strings 20 contact each other with less contact areas so that when the strings 20 are collected as a roll, the friction between the strings 30 are reduced and the term of use can be prolonged.

Figure 4:
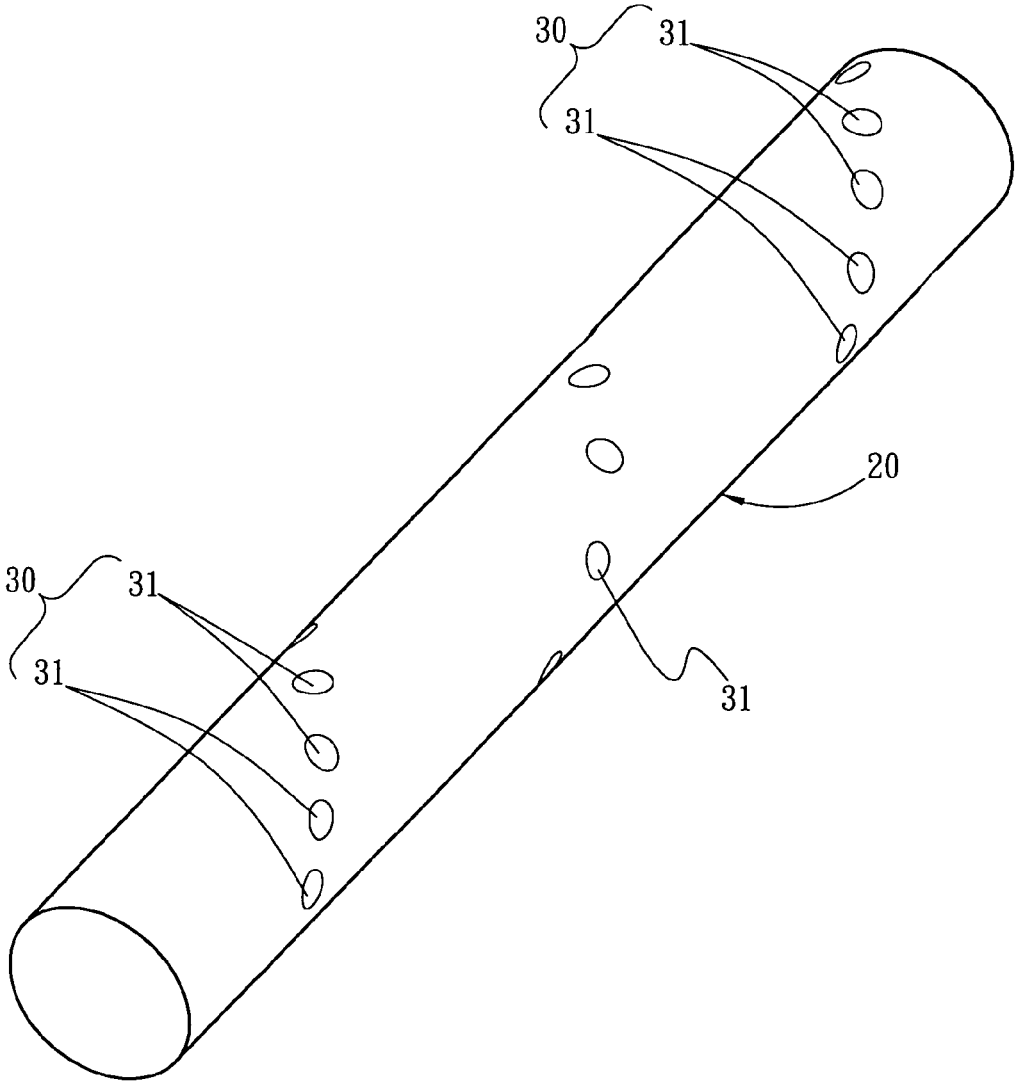
FIG. 4 is a perspective view to show a second embodiment of the string of the present invention.

FIG. 4 shows a second embodiment of the present invention wherein recesses 31 of the recess groups 30 are located spirally on the string 20. The recesses 31 have the same diameter and are circular recesses.

Figure 5:
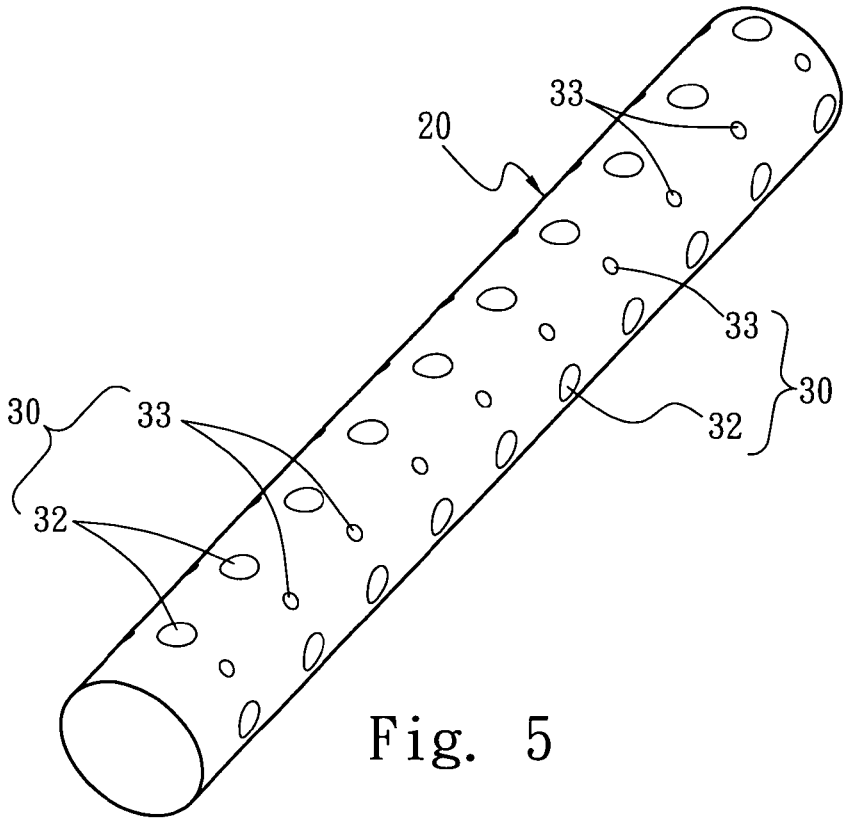
FIG. 5 is a perspective view to show a third embodiment of the string of the present invention.
Figure 6:
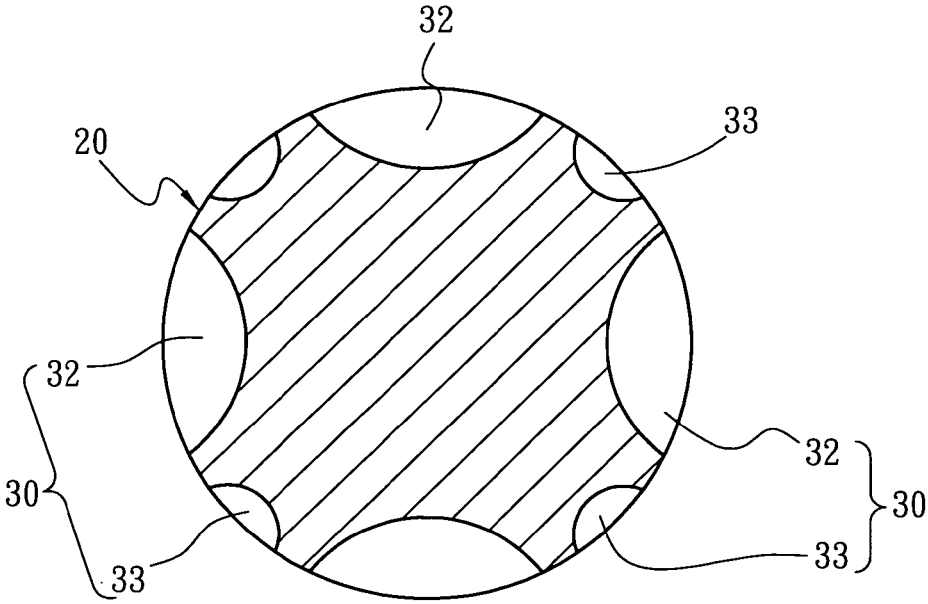
FIG. 6 is a cross sectional view of the third embodiment of the string of the present invention.

FIGS. 5 and 6 show the third embodiment, wherein the recess groups 30 include four first recesses 32 and four second recesses 33. The depth and the diameter of the first recesses 32 are deeper and larger than the depth and the diameter of the second recesses 33. The first and second recesses 32, 33 are located alternatively to each other and formed in lines respectively. That is to say, the first recesses 32 are formed as a line and the second recesses 33 are formed as another line which is located beside the line of the first recesses 32. The first recesses 32 and the second recesses 33 are located on the same cross section of the string 20.

Figure 7:
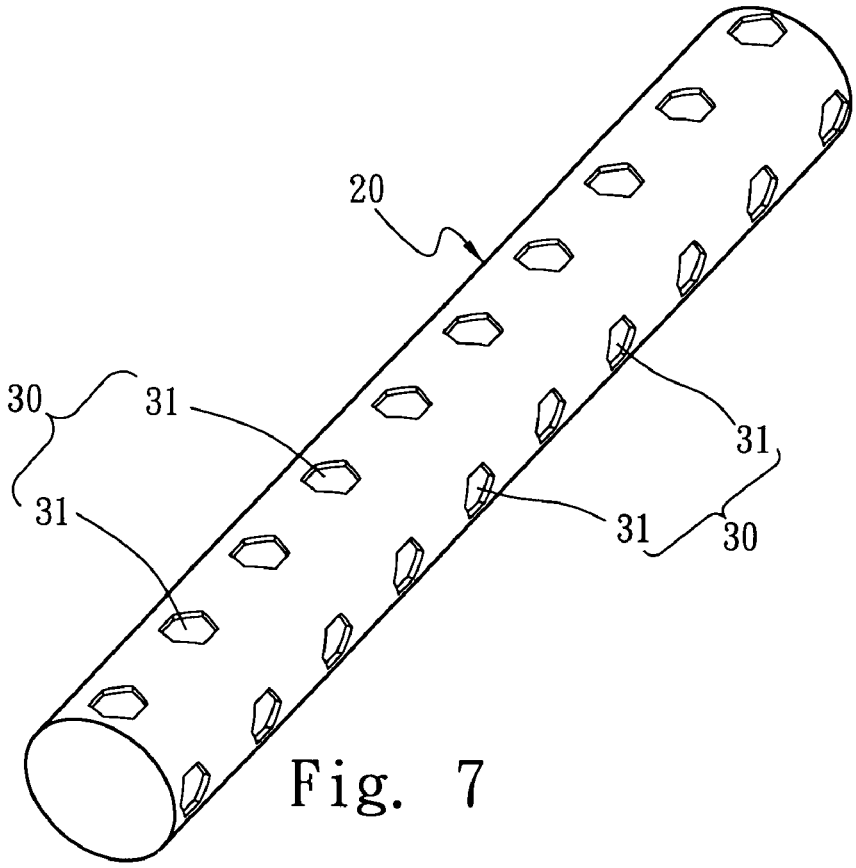
FIG. 7 is a perspective view to show a fourth embodiment of the string of the present invention.
Figure 8:
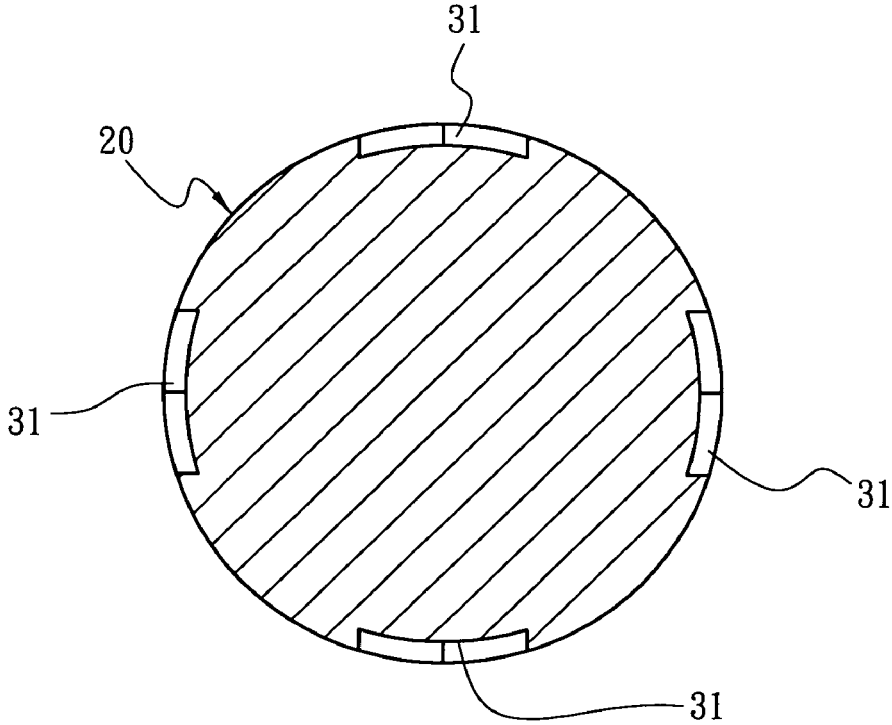
FIG. 8 is a cross sectional view of the fourth embodiment of the string of the present invention.

FIGS. 7 and 8 show the fifth embodiment of the present invention wherein the recesses 31 are hexagonal recesses and polygonal recesses.

Figure 9:
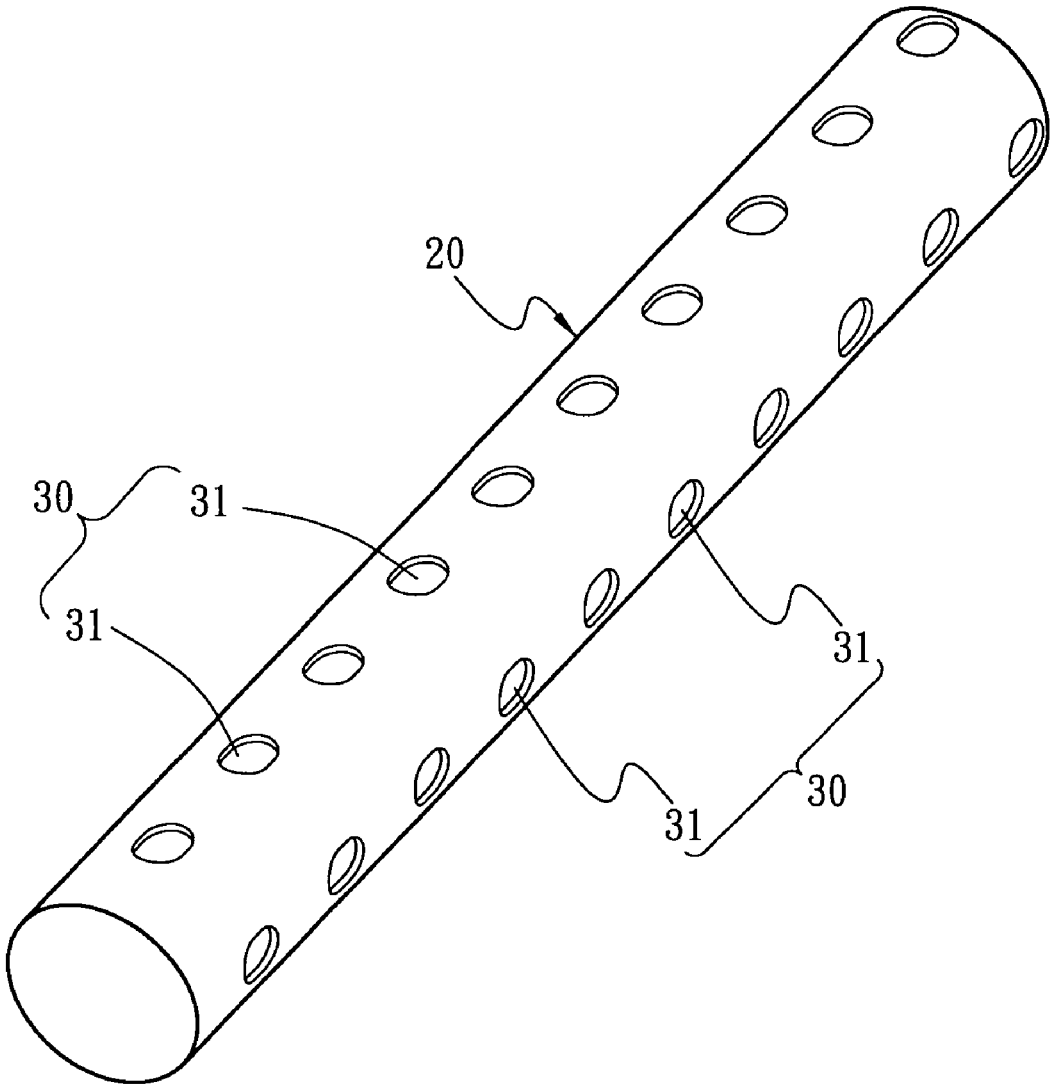
FIG. 9 is a perspective view to show a fifth embodiment of the string of the present invention.

FIG. 9 shows the fifth embodiment of the present invention wherein the recesses 31 are oval recesses.

Figure 10:
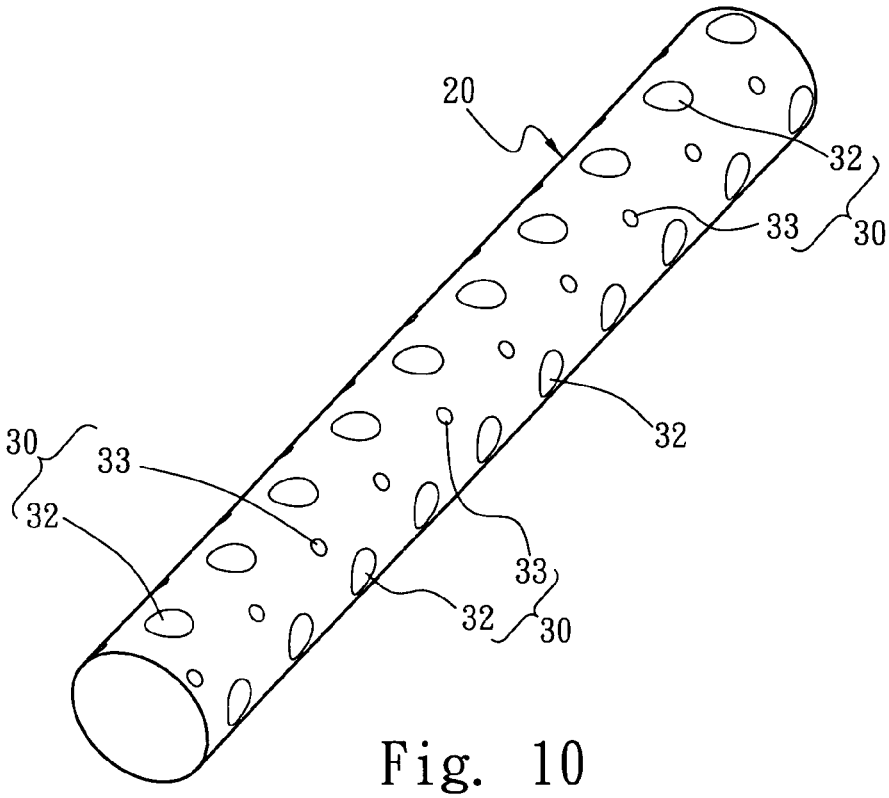
FIG. 10 is a perspective view to show a sixth embodiment of the string of the present invention.
Figure 11:
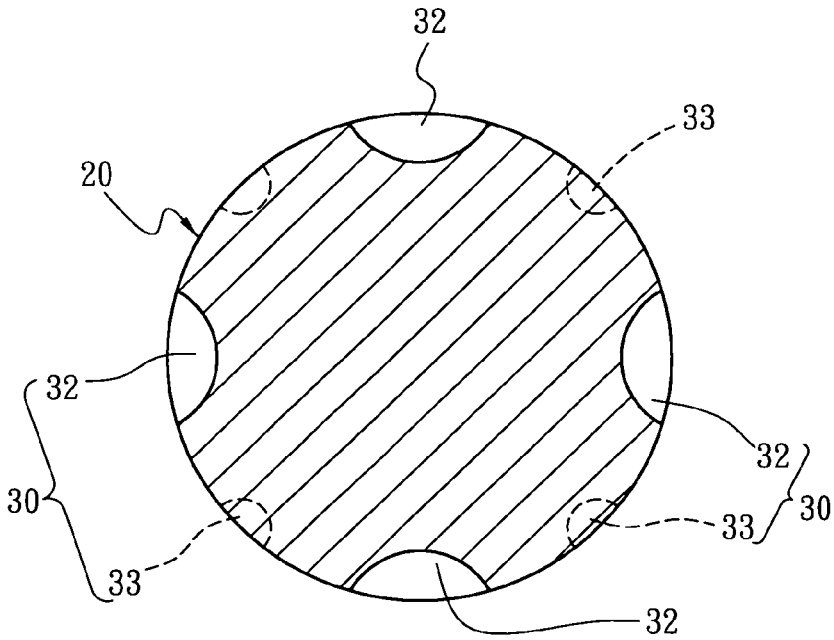
FIG. 11 is a cross sectional view of the sixth embodiment of the string of the present invention.

FIGS. 10 and 11 show the sixth embodiment of the present invention wherein the recess groups 30 include four first recesses 32 and four second recesses 33. The depth and the diameter of the first recesses 32 are deeper and larger than the depth and the diameter of the second recesses 33. The first and second recesses 32, 33 are located alternatively to each other and formed in lines respectively. That is to say, the first recesses 32 are formed as a line and the second recesses 33 are formed as another line which is located beside the line of the first recesses 32. The first recesses 32 and the second recesses 33 are located on different cross sections of the string 20.

The sizes, shapes and depths of the recesses 31 can be arranged in different manners when needed, such as the recesses 31 are arranged in spiral manner, linear manner and alternative manner.

Figure 12:
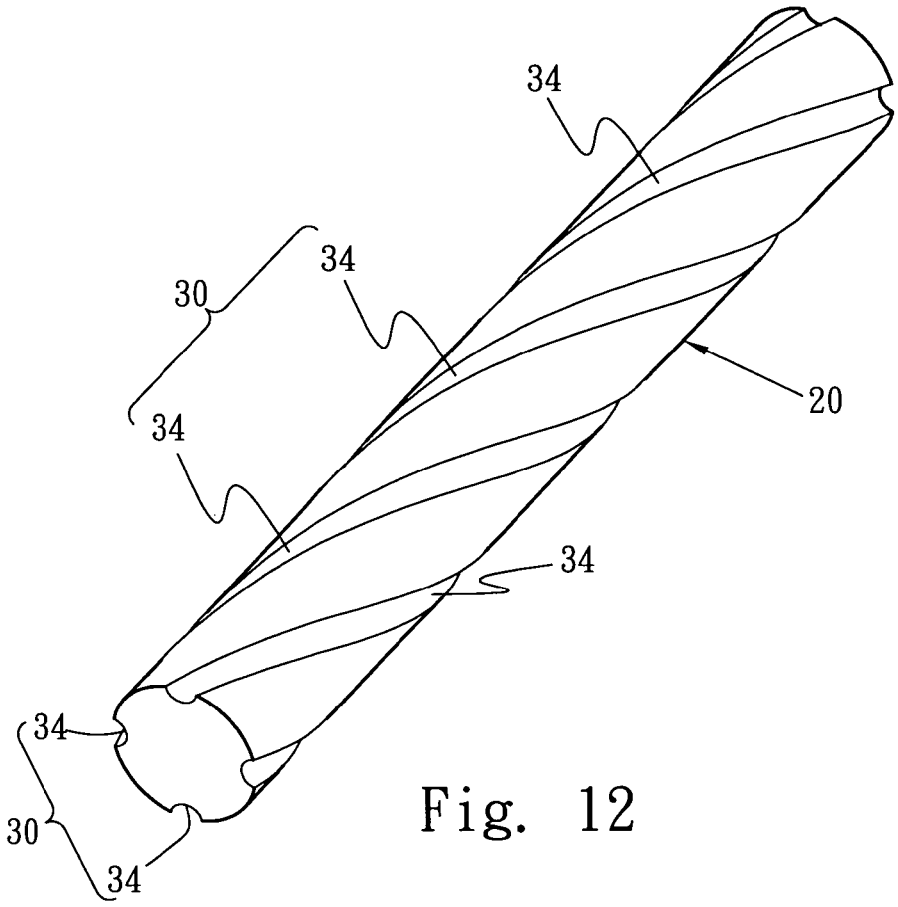
FIG. 12 is a perspective view to show a seventh embodiment of the string of the present invention.
Figure 13:
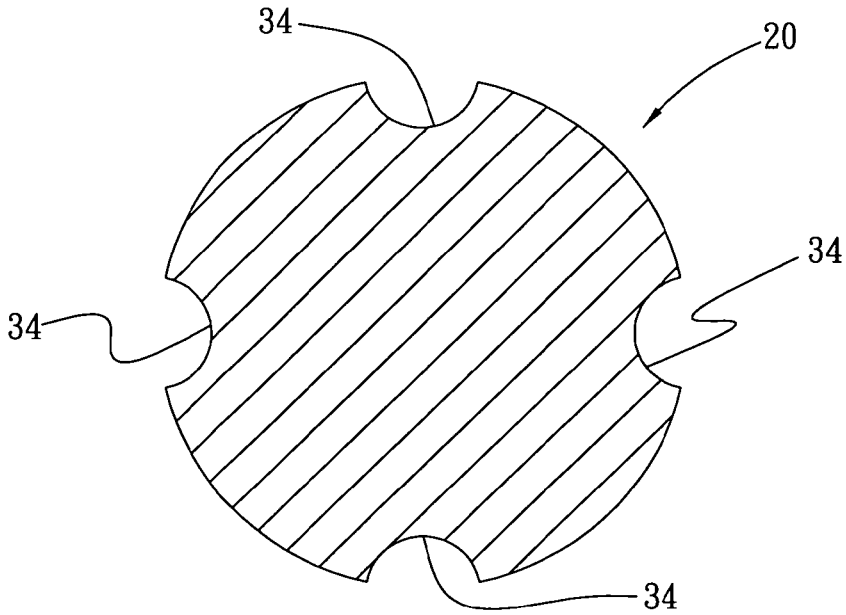
FIG. 13 is a cross sectional view of the seventh embodiment of the string of the present invention.

FIGS. 12 and 13 show the seventh embodiment of the present invention wherein the recess group 30 is formed as a continuous groove 34 and there are four continuous grooves 34 spirally defined in each string 20.

Figure 14:
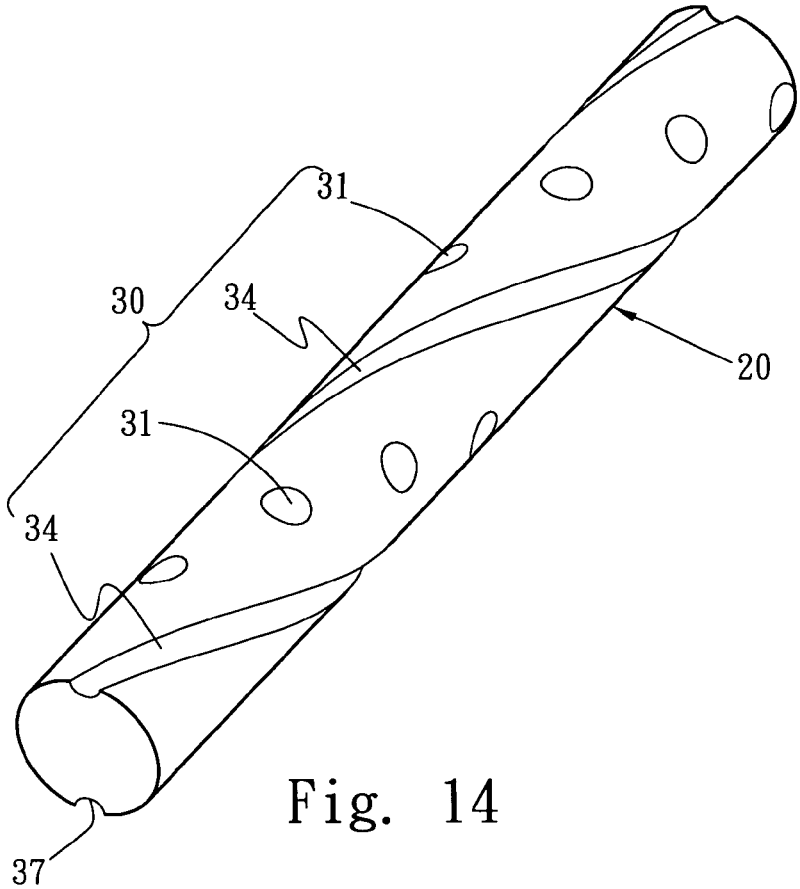
FIG. 14 is a perspective view to show an eighth embodiment of the string of the present invention.
Figure 15:
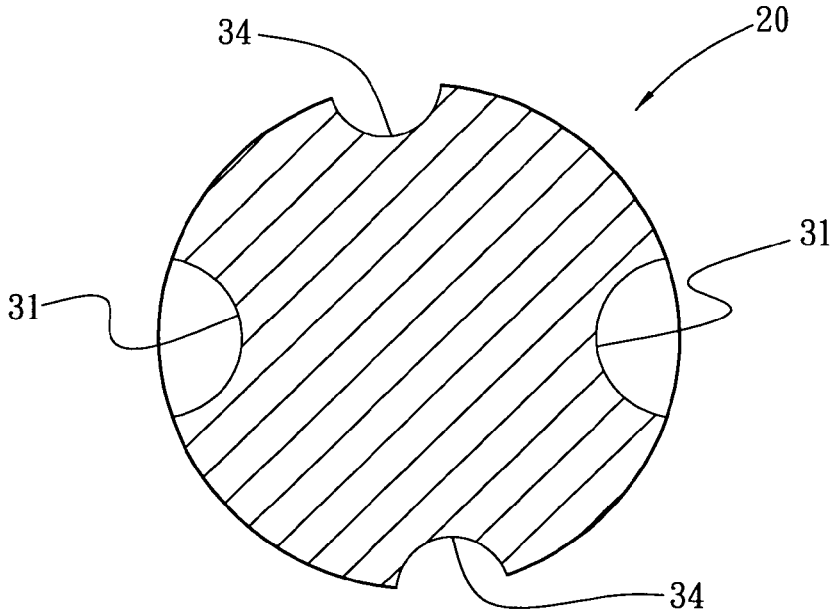
FIG. 15 is a cross sectional view of the eighth embodiment of the string of the present invention.

FIGS. 14 and 15 show the eighth embodiment, wherein the recess group 30 includes a continuous groove 34 and multiple recesses 31 which are located in a line with intervals located between the recesses 31. The recesses 31 are circular recesses. The continuous grooves 34 and the multiple recesses 31 are alternatively located in the string 20.

The strings 20 of the present invention include multiple recess groups which are composed of recesses 31. The recesses 31 are arranged in pre-determined manners as needed and increase friction between the balls and the strings 20 so that the users can easily control the balls when hitting the balls. The recesses 31 reduce the weight of the strings 20 and reduce the friction when the strings 20 are collected as a roll.

While we have shown and described the embodiment in accordance with the present invention, it should be clear to those skilled in the art that further embodiments may be made without departing from the scope of the present invention.

What is claimed is:

1. A sport racket string comprising:

a string being a solid string, and at least one recess group defined in an outer surface of the string;

wherein the at least one recess group includes first recesses and second recesses, a depth and a diameter of the first recesses are deeper and larger than a depth and a diameter of the second recesses, the first recesses and the second recesses are located alternatively on different cross sections of the string.

2. The string as claimed in claim 1, wherein the at least one recess group includes multiple recesses which are located in lines and intervals are formed between the recesses along each line.

3. The string as claimed in claim 2, wherein the at least one recess group is located parallel to a longitudinal axis of the string.

4. The string as claimed in claim 2, wherein the at least one recess group is located spirally on the string.

5. The string as claimed in claim 2, wherein the string includes multiple recess groups and distances are defined between the recess groups.

6. The string as claimed in claim 2, wherein the recesses are circular recesses.

7. The string as claimed in claim 2, wherein the recesses are hexagonal recesses.

8. The string as claimed in claim 2, wherein the recesses are polygonal recesses.

9. The string as claimed in claim 2, wherein the recesses are oval recesses.

10. The string as claimed in claim 1, wherein the at least one recess group includes first recesses and second recesses, a diameter of the first recesses is larger than a diameter of the second recesses, the first and second recesses are located alternatively to each other and formed in lines respectively.

11. The string as claimed in claim 1, wherein the at least one recess group includes first recesses and second recesses, a diameter of the first recesses is larger than a diameter of the second recesses, the first recesses and the second recesses are located at intervals and in lines respectively.

12. The string as claimed in claim 1, wherein the at least one recess group includes first recesses and second recesses, a depth of the first recesses is deeper than a depth of the second recesses, the first recesses and the second recesses are located and formed in lines respectively.

13. The string as claimed in claim 1, wherein the at least one recess group includes first recesses and second recesses, a depth of the first recesses is deeper than a depth of the second recesses, the first recesses and the second recesses are located at intervals and in lines respectively.

14. The string as claimed in claim 1, wherein the at least one recess group extends as a continuous groove.

15. The string as claimed in claim 14, wherein the continuous groove is located parallel to a longitudinal axis of the string.

16. The string as claimed in claim 14, wherein the continuous groove is located spirally in the string.

17. The string as claimed in claim 14, wherein a number of the at least one recess group is plural.

18. The string as claimed in claim 1, wherein the at least one recess group includes a continuous groove and multiple recesses which are located in a line with intervals located between the recesses, the continuous groove and the multiple recesses are alternatively located in the string.

* * * * *